United States Patent [19]

Tischer

[11] Patent Number: 4,762,469

[45] Date of Patent: Aug. 9, 1988

[54] ROTOR ANTI-REVERSE ROTATION ARRANGEMENT IN A SCREW COMPRESSOR

[75] Inventor: James C. Tischer, La Crescent, Minn.

[73] Assignee: American Standard Inc., New York, N.Y.

[21] Appl. No.: 835,575

[22] Filed: Mar. 3, 1986

[51] Int. Cl.[4] ..... F04B 49/00; F01C 1/16

[52] U.S. Cl. ..... 417/279; 417/310; 418/DIG. 1; 418/201

[58] Field of Search ..... 417/279, 307, 310, 507; 418/201, DIG.1, 84

[56] References Cited

U.S. PATENT DOCUMENTS

| | | | |
|---|---|---|---|
| 1,766,682 | 6/1930 | Pescara | 417/507 |
| 1,791,363 | 2/1931 | Lewis | 417/507 |
| 3,558,248 | 1/1971 | Darvier | 418/201 |
| 3,677,664 | 7/1972 | Wycliffe | 418/201 |
| 3,905,729 | 9/1975 | Bauer | 418/84 |
| 4,025,244 | 5/1977 | Sato | 418/DIG. 1 |
| 4,035,114 | 7/1977 | Sato | 418/84 |
| 4,076,461 | 2/1978 | Moody, Jr. et al. | 417/310 |
| 4,335,582 | 6/1982 | Shaw et al. | 62/196 |
| 4,388,046 | 6/1983 | Boller | 417/307 |
| 4,419,865 | 12/1983 | Szymaszek | 62/193 |

FOREIGN PATENT DOCUMENTS

| | | | |
|---|---|---|---|
| 338958 | 1/1977 | Austria . | |
| 1879671 | 5/1963 | Fed. Rep. of Germany . | |
| 2302046 | 7/1974 | Fed. Rep. of Germany . | |
| 2446378 | 5/1975 | Fed. Rep. of Germany . | |
| 1387738 | 3/1975 | United Kingdom | 417/279 |

*Primary Examiner*—William L. Freeh

*Attorney, Agent, or Firm*—William J. Beres; David L. Polsley; Robert J. Harter

[57] ABSTRACT

A body located downstream of the compressor discharge port in an oil-injected screw compressor assembly includes a contoured surface for directing the flow of the gas-oil mixture discharged from the compressor. The body is movable in the compressor assembly between a first position in which the flow of the mixture out of the discharge port is unimpeded and a second position in which the backflow of gas from downstream of the discharge port back into and through the working chamber of the compressor is prevented. In the first position the body facilitates the separation of oil from the discharged compressed gas while in the second position the reverse direction rotation of the screw rotors in the compressor working chamber is prevented. The body is positionable to the first position under the impetus of the mixture discharged from the compressor and is positionable to the second position under the impetus of the initial backflow of gas from downstream of the compressor, back to the compressor, which occurs upon compressor shutdown.

14 Claims, 3 Drawing Sheets

ROTOR ANTI-REVERSE ROTATION ARRANGEMENT IN A SCREW COMPRESSOR

DESCRIPTION

This patent is related to U.S. patent applications, Ser. Nos. 692,096 and 807,406, both assigned to the assignee of the present invention.

BACKGROUND OF THE INVENTION

The present invention relates generally to the art of compressing a gas in an oil-injected rotary screw compressor. More specifically, the present invention relates to the prevention of the high speed reverse rotation of screw rotors due to the backflow of gas from the high pressure portion of a screw compressor refrigeration circuit, through the compressor, to the low pressure portion of the circuit upon compressor shutdown.

Compressors are employed in refrigeration systems to raise the pressure of a refrigerant gas from a suction pressure to a higher discharge pressure which permits the ultimate use of the refrigerant to accomplish the cooling of a desired medium. Many types of compressors, including reciprocating, scroll and screw compressors, are used in refrigeration applications. Screw compressors employ complementary male and female screw rotors disposed within the working chamber of a rotor housing to compress gas. The working chamber can be characterized as a volume generally shaped as a pair of parallel intersecting cylindrical bores closely toleranced to the outside length and diameter dimensions of the screw rotors disposed therein. The screw rotor housing has low and high pressure ends which include suction and discharge ports respectively. Both the suction and discharge ports are in flow communication with the working chamber of the rotor housing.

Refrigerant gas at suction pressure enters the compressor working chamber via the suction port at the low pressure end of the rotor housing and is there enveloped in a pocket formed between the rotating complementary screw rotors. The volume of this chevron-shaped pocket decreases and the pocket is displaced toward the high pressure end of the compressor as the rotors rotate and mesh within the working chamber. The gas within such a pocket is compressed by virtue of the decreasing volume in which it is contained, until the pocket opens to the discharge port at the high pressure end of the compressor. As the pocket opens to the discharge port, the volume of the pocket continues to decrease and the compressed gas is forced through and out of the discharge port of the rotor housing.

Due to the extremely close tolerances between the rotors of the screw rotor set and the elements in the compressor which cooperate to define the working chamber in which the rotors are disposed, the bearing arrangement by which the rotor set is mounted within the working chamber is critical to compressor operation and life. The bearings in a screw compressor are subject to high axial and radial loads which can vary greatly from the low pressure end of the compressor to the high pressure end. Protection and lubrication of the rotor bearings is therefore of paramount concern in the design of rotary screw compressors. Since the suction and discharge ports of screw compressors are valveless and are essentially unobstructed openings into and out of the working chamber of the compressor, the rotor set within the working chamber is exposed, in operation, to the high pressure gas downstream of the compressor discharge port. Additionally, the gas undergoing compression in a pocket between the rotors bears against the high pressure end wall of the working chamber to create additional thrust on the rotors in a direction toward the low pressure end of the compressor. Therefore, a large axial thrust is developed, in operation, on the rotor set of a screw compressor in a direction from the high pressure end of the compressor to the low pressure end. This axial force must be compensated for by the compressor's bearing arrangement.

At compressor shutdown, the backflow of high pressure gas from the high pressure side of a refrigeration system through the open discharge port of the compressor toward the low pressure side of the system, if allowed to occur, would cause the high speed reverse rotation of the no longer driven screw rotors within the working chamber. Such freewheeling of the rotors could occur at speeds greater than the maximum design RPM of the rotor set and rotor bearings. Additionally, the resulting rush of downstream high pressure gas back through the compressor to the low pressure side of the system could result in a surge of pressure into the low pressure side of the system such that a higher pressure might momentarily develop at the suction end of the compressor than exists at the discharge end of the compressor. This situation would result in a re-surge of pressure and gas from what is normally the low pressure side of the system to what is normally the high pressure side of the system in attempt to equalize system pressures and would further result in inordinate and uncommonly large axial forces acting on the screw rotor set and rotor bearings in a direction opposite that normally expected and compensated for in operation. That is, axial force will be brought to bear on the screw rotor set and the bearings in which the rotors are mounted in a direction toward the high pressure end of the working chamber of the compressor. Several untoward results can occur if such high-speed reverse direction rotor rotation and the resulting pressure transients are allowed to occur. Among these results are the aforementioned development of axial thrust on the rotor set in a direction which is not compensated for to the degree normal axial thrust is compensated for within the compressor. Further, possible mechanical failure due to the achievement of rotor speeds exceeding design RPM might occur. Additionally, most, if not all, screw compressor bearing lubrication schemes are predicated on the development of pressure downstream of the compressor to drive lubricating oil to the rotor bearings. The high speed reverse rotation of the rotor set and momentary development of high pressures upstream of the working chamber, if allowed to occur, could theoretically cause oil to be sucked from the bearings or, in any event, not to be delivered to the bearings with possibly catastrophic results.

The number and complexity of patented screw compressor bearing and/or bearing lubrication schemes illustrates the ongoing need for an uncomplicated, inexpensive device by which bearing and/or bearing lubrication arrangements in screw compressors can be protected and simplified.

SUMMARY OF THE INVENTION

It is a principal object of this invention to prevent the high speed reverse rotation of the screw rotors in a screw compressor due to the backflow of previously compressed gas into and through the working chamber of the compressor subsequent to compressor shutdown.

It is a further object of this invention to prevent the development of axial thrust on the rotor set and the bearings in which the rotor set is mounted, in a screw compressor, in a direction opposite the direction of axial thrust developed on the rotor set in normal loaded operation of the compressor.

A still further object of the present invention is to facilitate and economize the design of a bearing arrangement in a screw compressor by eliminating the need for apparatus dedicated to the compensation of axial thrust in a direction opposite the direction in which axial thrust is developed in normal operation within a screw compressor.

Another object of this invention is to prolong the delivery of oil to the bearing arrangement in a screw compressor subsequent to the shutdown of the compressor, particularly while the rotor set coasts to a stop upon compressor shutdown.

It is another object of this invention to assist in the separation of oil from the mixture of oil and gas discharged from an oil injected screw compressor by imparting a smooth change in direction in the mixture to facilitate disentrainment of the oil while minimizing pressure drop in the discharge gas.

Finally, it is another object of this invention to assist in the positioning of the slide valve assembly in a screw compressor to the full unload position upon compressor shutdown.

The objects of the invention are accomplished by the disposition of an aerodynamically-shaped body downstream of and in line with the discharge port or discharge passage within a screw compressor assembly in a refrigeration circuit. In a first or retracted position, the valve body allows for the unimpeded discharge of the compressed gas-oil mixture from an oil injected screw compressor in a refrigeration circuit. The valve body is carried away from the discharge port or passage under the impetus of the mixture discharged from the compressor until it seats on a stop. An aerodynamically-shaped surface on the valve body faces into the mixture discharged from the compressor and deflects that mixture with the result that the mixture is imparted a radial velocity vector. This change in direction itself facilitates disentrainment of liquid from the mixture. Additionally, such deflection aids in the delivery from the mixture in an advantageous manner to a centrifugal oil separator while minimizing the pressure drop in the compressed refrigerant gas portion of the mixture.

The valve body is slideably disposed on a rod so that upon compressor shutdown, the initial backflow of high pressure gas downstream of the compressor section to the low pressure side of the system, via the compressor discharge port and working chamber, carries the valve body into the discharge port or passage to essentially stop such backflow at the outset. System pressures will then equalize at a much slower rate and the rush of high pressure gas back through the working chamber of the compressor and the resultant high speed reverse rotation of the rotors will be prevented. In systems where the slide valve actuating piston is exposed to discharge pressure and is biased to the unload position by such pressure, the maintenance of pressure in the high pressure side of the system subsequent to compressor shutdown facilitates and insures the movement of the slide valve to the unload position within the compressor assembly. Further, the maintenance of pressure downstream of the compressor insures the continued delivery of oil to critical compressor locations as the rotors coast to a stop.

DESCRIPTION OF THE PREFERRED EMBODIMENT

Figure 1:
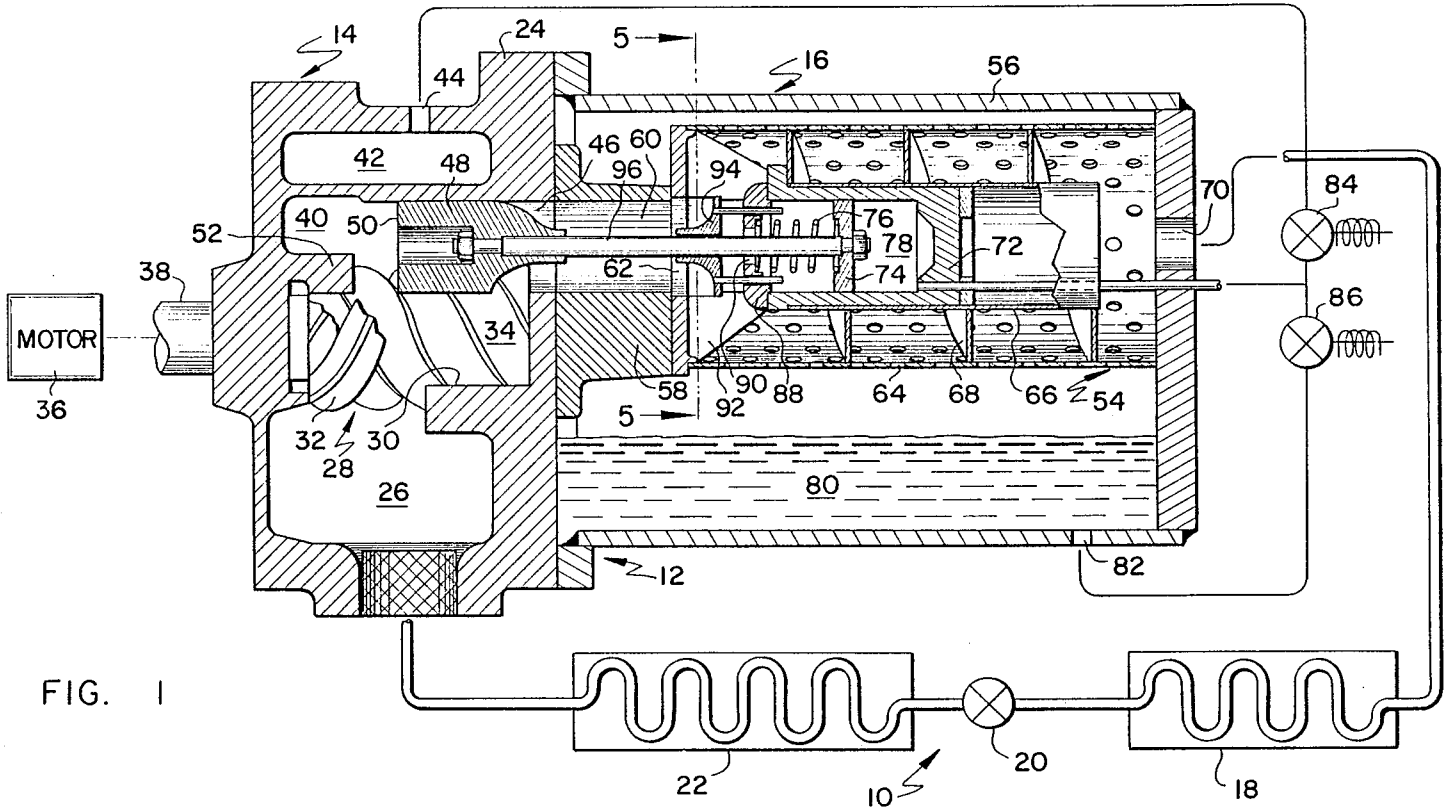
FIG. 1 is a cross-sectional view of a screw compressor operating at part-load conditions in a refrigeration circuit.

Referring first to FIG. 1, a refrigeration system 10 includes a screw compressor assembly 12 which is comprised of a compressor section 14 and an oil separator section 16. Refrigeration system 10 further includes, typically, a condenser 18, an expansion device 20 and an evaporator 22. Compressed refrigerant gas, from which oil has been separated, is directed from oil separator section 16 of compressor assembly 12 to condenser 18 where it is condensed and becomes a low temperature, high pressure liquid. From condenser 18 the refrigerant is directed to expansion device 20 where it becomes a low temperature, low pressure liquid by the process of expansion. The low pressure, low temperature liquid refrigerant next enters evaporator 22 and is there vaporized and becomes a low pressure low temperature gas prior to being returned to compressor section 14.

Compressor section 14 includes a rotor housing 24 which defines a suction area 26, into which vaporized low pressure refrigerant gas is communicated from evaporator 22. Rotor housing 24 also defines a suction port 28 through which such gas is admitted to compressor working chamber 30. Screw rotors 32 and 34 are housed in working chamber 30. Attached to the driven one of rotors 32 and 34 is motor 36 which drives shaft 38 on which the driven rotor is mounted. Suction area 26, in the preferred embodiment, includes suction subareas 40 and 42 all of which are in flow communication within rotor housing 24. Rotor housing 24 also defines an opening 44 into suction subarea 42, the purpose of which will later be described.

Rotor housing 24 further includes a discharge port 46 through which compressed refrigerant gas is discharged from working chamber 30. Disposed within rotor housing 24 and cooperating therewith to define working chamber 30 is a slide valve 48. Slide valve 48 is axially movable with respect to rotors 32 and 34 within rotor housing 24. In the position illustrated in FIG. 1, working chamber 30 is in flow communication with suction subarea 40 of suction area 26 as well as suction area 26 through suction port 28. Slide valve 48 is positionable between a first position in which low pressure end face 50 of the valve abuts stop 52 of rotor housing 24 and a second position, illustrated in FIG. 2, in which the degree to which rotors 32 and 34 are exposed to suction subarea 40 is at a maximum. When low pressure end face 50 of valve 48 abuts stop 52 of rotor housing 24, direct flow communication between working chamber 30 and suction subarea 40 is prevented and the compressor operates at full load. In the position illustrated in FIG. 1, slide valve 48 is at an intermediate position representing a position where the compressor is operating at part-load conditions. The degree to which rotors 32 and 34 are exposed to suction subarea 40 is determinitive of the volume of gas which will be compressed between the rotors and therefore, the load on the compressor.

Figure 2:
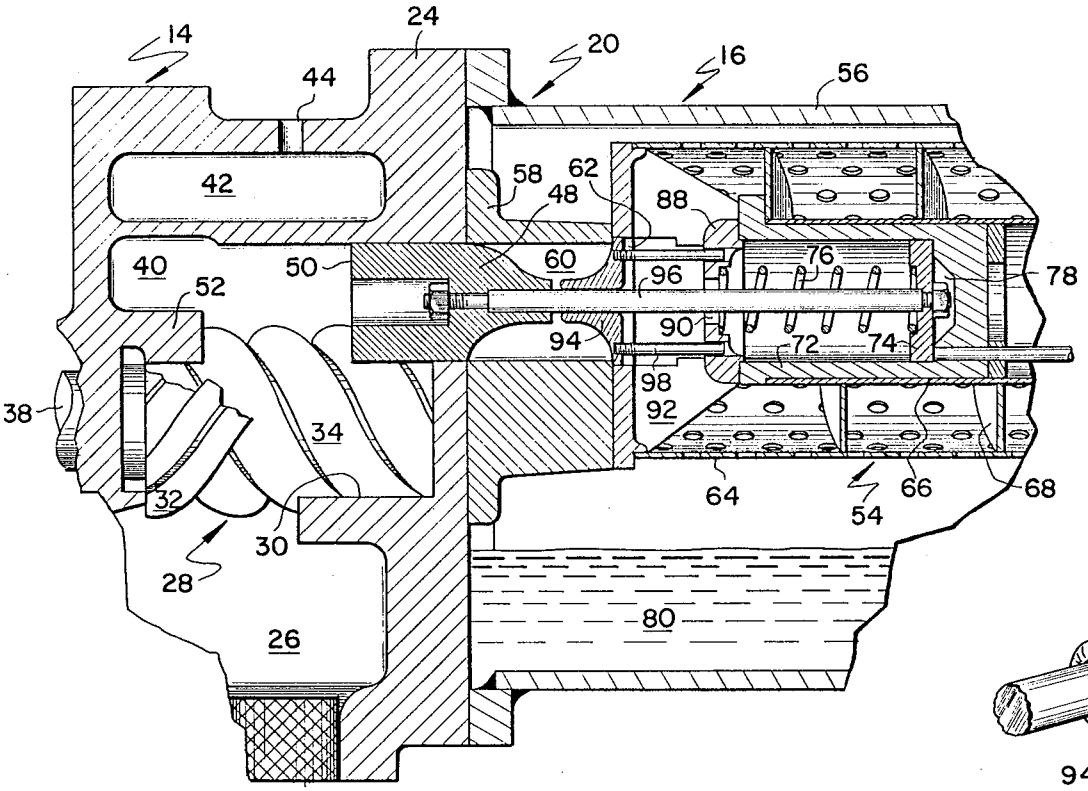
FIG. 2 is a partial cross section of the compressor assembly of FIG. 1 illustrating the position of compressor assembly components when the compressor is both shut down and unloaded.

Referring now to both FIGS. 1 and 2, oil separator section 16 includes a centrifugal oil separator element 54 disposed within a sealed oil sump housing 56. In the preferred embodiment, a bearing housing 58 defining a discharge passage 60 is disposed between discharge port 46 of rotor housing 24 and separator element 54. Separator element 54 defines an inlet 62 in flow communication with passage 60 of bearing housing 58 and includes a permeable wall 64 which cooperates with inner cylindrical housing 66 and ramp 68 to define a helical passage between inlet 62 and outlet 70 of sump housing 56.

Inner cylindrical housing 66 includes a pressure housing 72 in which piston 74 and spring 76 are disposed. Piston 74 and pressure housing 72 cooperate to define a pressure chamber 78 which is capable of selective flow communication with opening 44 in rotor housing 24 or with sump area 80 of oil separator 16 through opening 82 in sealed sump housing 56. Pressure chamber 78 is put into flow communication with opening 44 and suction subarea 42 by the opening of solenoid valve 84 or with sump area 80 by the opening of solenoid valve 86. Housing 66 has an end cap 88 which defines an opening 90 through which the face of piston 74 opposite the face which cooperates to define chamber 78 is constantly maintained in flow communication with the remainder of the interior of oil separator element 54.

Also disposed interior of separator element 54 are swirl vanes 92 and anti-rotation body 94. Body 94, as will more thoroughly be discussed, is slidably mounted on connecting rod 96 which connects piston 74 within oil separator section 16 and slide valve 48 within rotor housing 24. It will be appreciated that when piston 74 moves within pressure housing 72, slide valve 48 is correspondingly moved within rotor housing 24 and further, that the movement of rod 96 does not of itself affect the movement of body 94.

Figure 4:
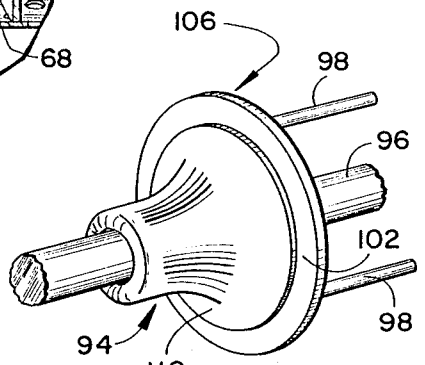
FIG. 4 is a perspective view of the anti-rotation body of the present invention.
Figure 5:
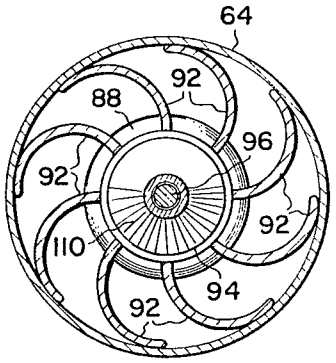
FIG. 5 is a sectional view taken along line 5—5 of FIG. 1.
Figure 3:
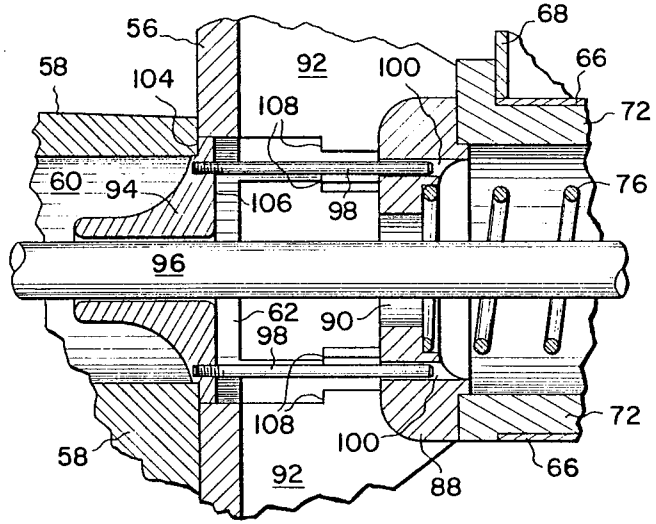
FIG. 3 is a partial cross-sectional view of the inlet area of the oil separator section of the compressor assembly of FIG. 1.

Referring to FIGS. 3, 4 and 5, body 94 is restrained from rotation around connecting rod 96 by pins 98 which are attached to body 94 and which are slidably disposed for movement through holes 100 in end cap 88. Further, it will be seen that flange portion 102 of body 94 is prevented from moving toward discharge passage 60 any further than is illustrated in FIGS. 2 and 3 by seating surface 104, which as illustrated in the Figures, is a flat surface on bearing housing 58. Likewise, body 94 is prevented from moving toward opening 90 of end cap 88 any more than is illustrated in FIG. 1, by the abutment of back surface 106 of body 94 with seats 108 on swirl vanes 92. In this way a gap is maintained between back surface 106 of body 94 and end cap 88 to ensure that opening 90 of end cap 88 is unobstructed at all times so as to maintain flow communication between one side of piston 74 and the remainder of the interior of separator element 54. Back face 106 of body 94 is flat while face 110 of body 94, which faces into discharge passage 60, is aerodynamically contoured.

In operation, refrigerant gas is sucked into working chamber 30 through suction port 28 by the rotation and meshing of rotors 32 and 34, one of which is driven in a predetermined direction by motor 36. When motor 36 is in operation, at least a portion of the refrigerant gas sucked in through suction port 28 into working chamber 30 is compressed and discharged through discharge port 46 no matter what the position of slide valve 48. As illustrated in FIG. 1, compressed refrigerant gas is discharged from working chamber 30 through discharge port 46 and into discharge passage 60 of bearing housing 58. Although not illustrated, oil from sump 80 is injected into working chamber 30 while the compressor is in operation. Oil in sump 80 is essentially at discharge pressure when the compessor assembly is in operation due to the permeability of wall 64 of separator element 54. The oil from sump 80 is further employed to lubricate the bearings and the bearing areas in which the ends of the shafts of rotors 32 and 34 are mounted in the compressor assembly. Such lubricating oil is vented into the working chamber of the compressor after it passes through the bearings and bearing areas. Additionally, sump oil is selectively directed out of sump 80 through solenoid valve 86, when valve 86 is opened, and into pressure chamber 78 to cause the movement of piston 74 and the corresponding movement of slide valve 48 in rotor housing 24. When it is desired that the slide valve should be moved so as to unload the compressor, pressure chamber 78 is vented through solenoid valve 84 into suction subarea 42 of rotor housing 24. It will readily be appreciated that what is discharged from discharge port 46 of rotor housing 24 is compressed refrigerant gas heavily laden with the oil which makes its way into the working chamber from the many locations described above.

The mixture of oil and refrigerant gas discharged from compressor section 14 enters oil separator portion 16 through inlet 62 and immediately impinges on contoured face 110 of anti-rotation body 94. Such impact initially serves to carry body 94 away from discharge port 46 until back face 106 contacts seats 108 of swirl vanes 92. While the discharge of the oil-refrigerant gas mixture continues, body 94 will remain seated against seats 108 and in the position illustrated in FIG. 1 under the influence of the force of the mixture being discharged from the working chamber of the compressor section. The area around inlet 62 of oil separator element 54 will be saturated with oil as the discharge mixture impacts contoured face 110 of body 94. Consequently, body 94 slides easily on rod 96. A small amount of leakage past body 94 through the gap between rod 96 and the hole defined by body 94 through which rod 96 passes is not detrimental. A somewhat loose fit between rod 96 and body 94 is therefore permissible and insures the easy sliding of body 94 on rod 96.

The mixture of refrigerant gas and oil entering inlet 62 of oil separator element 54 is forced by interaction with contoured face 110 of body 94 to undergo a smooth transition from essentially axial flow to a combination of axial and radial flow within separator element 54. The mixture is thus fed into swirl vanes 92, which impart a rotational or swirling motion to the mixture in a predetermined direction, already having been imparted a radial velocity vector by body 94. This preswirled mixture is next fed into the helical passage defined within separator element 54 by ramp 68, permeable wall 64 and inner housing 66. The gradual and smooth directional changes imparted to the mixture are purposeful and minimize pressure drop in the compressed refrigerant gas during the oil separation process. As the high pressure mixture moves through separator element 54, the centrifugal force developed within the mixture due to its flow path causes the heavier liquid portion of the mixture to migrate radially outward within the separator element and to pass through permeable wall 64. The gas from which the oil has been separated continues to move through the separator element and out of sealed housing 56 through outlet 70. The separated oil is deposited in sump 80 of sealed housing 56.

Upon shutdown of the compressor, that is, when motor 36 is de-energized and the rotors are no longer driven, the high pressure gas within and downstream of separator element 54 will tend to rush back through inlet 62, discharge passage 60 and discharge port 46 of rotor housing 24 and into working chamber 30. Such backrush of gas will, unless prevented, cause the rotors to be driven in a direction opposite that in which they are driven by motor 36 and at possibly unacceptably high speeds. The rotors are free to freewheel in any direction whenever they are no longer driven by motor 36. The initial backrush of such gas out of oil separator element 54 will, however, carry body 94 along rod 96 toward the compressor section until flange portion 102 of body 94 seats against seat 104 effectively plugging inlet 62 and preventing further backflow from occurring. It will be appreciated that the length of time it takes for the refrigeration system high pressure and low pressure sides to equalize will thus be prolonged while the high speed reverse rotation of the rotors is prevented. The prolonged maintenance of pressure downstream of inlet 62 of oil separator element 54 further insures that the delivery of oil to the aforementioned rotor shaft bearings and working chamber of the compressor continues to occur immediately subsequent to compressor shutdown since it is the high pressure developed and maintained within oil separator section 16 which, in operation, drives oil from sump 80 to its places of employment within compressor assembly 12.

The maintenance of pressure in oil separator section 16 at shutdown also assists spring 76 in biasing the slide valve 48 to the unload position within rotor housing 24 and as illustrated in FIG. 2. Upon compressor shutdown, solenoid valve 84 is automatically opened so as to vent pressure chamber 78. The pressure within oil separator 16 bears on the same side of piston 74 as does spring 76. When body 94 plugs inlet 62 so as to prevent the rush of gas back through inlet 62 to the low pressure side of system 10, the pressure trapped within oil separator element 54 will act on piston 74 in conjunction with spring 76 with the result that slide valve 48 will be moved to the unload position in rotor housing 24. Once body 94 plugs inlet 62, valve 48 will no longer itself be acted upon by discharge pressure at the discharge port and the movement of the valve to the unload position shown in FIG. 2 will be assured.

What is claimed is:

1. Apparatus for preventing the reverse rotation of screw rotors in a screw compressor upon compressor shutdown comprising:

a body located downstream of the discharge port of said compressor and moveable with respect to said discharge port between a first position in which the flow of compressed gas from said discharge port is unimpeded while said compressor is in operation and a second position in which the backflow of gas through said discharge port from downstream of said compressor is prevented, said body having a contoured surface; and means for mounting said body for movement between said first and said second positions, said body being mounted on said mounting means so that said contoured surface faces into the flow of gas discharged from said compressor, said contoured surface diverting the discharge gas which impacts it.

2. The apparatus according to claim 1 wherein said body is mounted for slidable movement on said mounting means and is positionable in said first position under the impetus of gas discharged from said compressor when said compressor is in operation and is positionable in said second position under the impetus of the flow of discharge gas back toward the discharge port of said compressor which occurs when said compressor is shutdown.

3. The apparatus according to claim 2 wherein said mounting means is a rod and wherein said contoured surface of said body is symmetrical about an axis, said body defining a bore coincident with the axis of symmetry of said contoured surface and said bore penetrated by said rod.

4. The apparatus according to claim 3 further comprising means for preventing said body from rotating on said rod.

5. The apparatus according to claim 4 wherein said body has a seating surface on the same side of said body as said contoured face.

6. The apparatus according to claim 4 wherein said rotation preventing means comprises at least one pin attached to and movable with said valve body as said body moves slidably on said rod.

7. A screw compressor assembly in a refrigeration system comprising:

an oil-injected compressor section, said compressor section including a screw rotor housing defining a working chamber and a discharge port in flow communication with said working chamber, said compressor section further including a pair of complimentary screw rotors disposed for rotation in said working chamber, said compressor discharge port receiving a mixture of oil and gas compressed by the rotation of said rotors in a predetermined direction within said working chamber when said compressor section is in operation and said rotors being free to freewheel in a direction opposite said predetermined direction when said motor is de-energized;

an oil separator section in flow communication with the discharge port of said compressor section; and means disposed downstream of the discharge port of said compressor section, for preventing the rotation of said screw rotors in a direction opposite said predetermined direction due to the backflow of previously compressed gas from downstream of said discharge port back to and through said working chamber upon compressor shutdown, said means for preventing rotation comprising a body having a symmetrical contoured surface facing into the gas-oil mixture discharged through said discharge port when said motor is energized, said body being positioned under the impetus of the gas-oil mixture discharged from said discharge port, when said compressor section is in operation, to a first position in which the flow of said mixture through said discharge port is unimpeded and to a second position, under the impetus of the initial backflow of gas from downstream of said discharge port which occurs when said motor is de-energized, said body preventing the backflow of previously compressed gas into said compressor section when in said second position.

8. The compressor assembly according to claim 7 wherein said oil separator section includes a centrifugal oil separator element, said contoured surface of said body cooperating with said oil separator element so that the impact of said gas-oil mixture discharged by said compressor on said contoured surface of said body directs said mixture into said separator element in a manner facilitating the separation of oil from said mixture in said separator element.

9. The compressor assembly according to claim 8 wherein said body defines a bore coaxial with the axis of symmetry of said contoured surface, said body being slidably disposed for movement between said first and said second positions on a rod which passes through said bore.

10. The compressor assembly according to claim 9 further comprising means for preventing said body from rotating around said rod.

11. The compressor assembly according to claim 10 wherein said centrifugal oil separator element defines an inlet and includes a plurality of swirl vanes juxtaposed said inlet and wherein in said first position said body seats in said separator element so that said mixture discharged from said compressor section is imparted a radial velocity vector by said body prior to entering said swirl vanes.

12. The compressor assembly according to claim 11 further comprising a slide valve disposed for movement in said compressor section and a slide valve actuator piston disposed for movement in said oil separator section, said valve and said piston being connected by said rod on which said body is disposed so that movement of said piston in said oil separator portion results in the corresponding movement of said slide valve in said oil separator section, the movement of said body on said rod being independent of the movement of said rod which occurs in response to the movement of said actuator piston.

13. The compressor assembly according to claim 12 wherein one face of said actuator piston is in flow communication with the interior of said separator element irrespective of whether said body is in said first or said second position whereby upon compressor shutdown pressure within said oil separator section and on said piston is maintained while system pressures equalize other than through the discharge port of said compressor.

14. The compressor assembly according to claim 13 wherein said body rotation preventing means comprises at least one pin attached to and movable with said valve body as said body moves slidably on said rod, the movement of said at least one pin being constrained to movement parallel to said rod.

* * * * *